US009259599B2

(12) United States Patent
Stanhope et al.

(10) Patent No.: US 9,259,599 B2
(45) **Date of Patent: *Feb. 16, 2016**

(54) FLAME RESISTANT FABRIC WITH ANISOTROPIC PROPERTIES

(71) Applicant: Southern Mills, Inc., Union City, GA (US)

(72) Inventors: Michael T. Stanhope, Atlanta, GA (US); Charles S. Dunn, Griffin, GA (US); Matthew Lucius Colatruglio, Roswell, GA (US)

(73) Assignee: Southern Mills, Inc., Union City, GA (US)

( * ) Notice: Subject to any disclaimer, the term of this patent is extended or adjusted under 35 U.S.C. 154(b) by 168 days.

This patent is subject to a terminal disclaimer.

(21) Appl. No.: 14/520,056

(22) Filed: Oct. 21, 2014

(65) Prior Publication Data

US 2015/0297919 A1 Oct. 22, 2015

Related U.S. Application Data

(63) Continuation of application No. 13/303,495, filed on Nov. 23, 2011, now Pat. No. 8,898,821, which is a continuation-in-part of application No. 12/783,368, filed on May 19, 2010, now abandoned.

(60) Provisional application No. 61/179,461, filed on May 19, 2009.

(51) Int. Cl.

| | |
|---|---|
| ***A62B 17/00*** | (2006.01) |
| ***D03D 15/12*** | (2006.01) |
| ***D02G 3/44*** | (2006.01) |
| ***D03D 1/00*** | (2006.01) |
| ***D03D 41/00*** | (2006.01) |
| *A41D 31/00* | (2006.01) |

(52) U.S. Cl.

CPC ..... *A62B 17/003* (2013.01); *D02G 3/443* (2013.01); *D03D 1/0035* (2013.01); *D03D 15/12* (2013.01); *D03D 41/00* (2013.01); *D10B 2201/00* (2013.01); *D10B 2201/01* (2013.01); *D10B 2201/22* (2013.01); *D10B 2201/28* (2013.01); *D10B 2321/101* (2013.01); *D10B 2331/02* (2013.01); *D10B 2331/021* (2013.01); *D10B 2403/011* (2013.01); *D10B 2501/04* (2013.01); *D10B 2507/00* (2013.01); *Y10T 442/3984* (2015.04)

(58) Field of Classification Search

CPC ..... D03D 15/12; D03D 15/00; D03D 13/004; D03D 25/00; D06M 2200/30; A41D 31/0022; A41D 1/02; A41D 31/0027; D04B 21/04; D10B 2331/021; D10B 2501/04; A62B 17/003

USPC ..... 2/458; 139/383 R, 420 R, 420 A

See application file for complete search history.

(56) References Cited

U.S. PATENT DOCUMENTS

| | | | | |
|---|---|---|---|---|
| 2,333,824 | A | | 11/1943 | Shoepf |
| 2,696,723 | A | | 12/1954 | Frith, Jr. |
| 3,097,442 | A | | 7/1963 | Willingham, Jr. |
| 3,806,959 | A | | 4/1974 | Gross |
| 4,615,934 | A | | 10/1986 | Ellison |
| 4,668,234 | A | | 5/1987 | Vance et al. |
| 4,920,000 | A | | 4/1990 | Green |
| 5,141,542 | A | | 8/1992 | Fangeat et al. |
| 5,150,476 | A | * | 9/1992 | Statham et al. ..... 2/93 |
| 5,323,815 | A | | 6/1994 | Barbeau et al. |
| 5,527,597 | A | * | 6/1996 | Stanhope et al. ..... 442/184 |
| 5,539,928 | A | | 7/1996 | Aldridge |
| 5,640,718 | A | | 6/1997 | Aldridge |
| 5,685,015 | A | | 11/1997 | Aldridge |
| 5,694,981 | A | * | 12/1997 | Stanhope et al. ..... 139/383 R |
| 5,724,673 | A | | 3/1998 | Aldridge |
| 5,727,401 | A | * | 3/1998 | Statham ..... 66/176 |
| 5,819,316 | A | | 10/1998 | Aldridge |
| 5,824,614 | A | | 10/1998 | Gadoury et al. |
| 5,830,574 | A | | 11/1998 | Gadoury |
| 5,849,648 | A | | 12/1998 | Kent et al. |
| 5,858,888 | A | | 1/1999 | Underwood |
| 5,885,307 | A | | 3/1999 | Gadoury |
| 5,891,813 | A | | 4/1999 | Gadoury |

(Continued)

FOREIGN PATENT DOCUMENTS

| | | |
|---|---|---|
| AU | 2005200963 | 3/2005 |
| DE | 20 2004 005008 U1 | 6/2004 |

(Continued)

OTHER PUBLICATIONS

Supplementary Search Report, European Patent Application No. 12851301.7, mailed Jan. 20, 2015.

Partial Search Report, PCT Application No. PCT/US2009/030111, mailed Apr. 23, 2009.

International Search Report and Written Opinion, PCT Application No. PCT/US2012/066227 , Feb. 28, 2013, 9 pages.

"Lion Ready for Action", Dec. 21, 2011.

"Tools & Technologies: Fire Service Prepares for Change in PPE Technology", Feb. 1, 2012.

Examiner's Report, Australian Patent Application No. 2012318301, mailed Sep. 11, 2014.

Response to Rule 161 Communication, European Patent Application No. 12851301.7, filed Oct. 6, 2014.

*Primary Examiner* — Bobby Muromoto, Jr.

(74) *Attorney, Agent, or Firm* — Kilpatrick Townsend & Stockton LLP

(57) ABSTRACT

Flame resistant fabrics are formed by warp and fill yarns having different fiber contents. The fabrics are constructed, for example, by selection of a suitable weaving pattern, such that the body side of the fabric and the face side of the fabric have different properties. The fabrics described herein can be printable and dyeable on both sides of the fabric and are suitable for use in military and industrial garments. Methods of forming flame resistant fabrics, and methods for forming garments from the fabrics, are also described.

81 Claims, No Drawings

(56) References Cited

U.S. PATENT DOCUMENTS

| | | | | |
|---|---|---|---|---|
| 5,920,905 | A | 7/1999 | Aldridge | |
| 5,928,971 | A * | 7/1999 | Ellis et al. | 442/76 |
| 6,132,476 | A * | 10/2000 | Lunsford et al. | 8/531 |
| 6,247,179 | B1 | 6/2001 | Underwood et al. | |
| 6,430,754 | B1 | 8/2002 | Taylor et al. | |
| 6,547,835 | B1 * | 4/2003 | Lunsford et al. | 8/531 |
| 6,626,964 | B1 * | 9/2003 | Lunsford et al. | 8/531 |
| 6,668,868 | B2 | 12/2003 | Howland et al. | |
| 6,693,052 | B2 | 2/2004 | Howland | |
| 6,735,789 | B2 * | 5/2004 | Kelleher et al. | 2/458 |
| 6,818,024 | B2 * | 11/2004 | Lunsford et al. | 8/531 |
| 6,840,288 | B2 | 1/2005 | Zhu et al. | |
| 6,861,378 | B2 | 3/2005 | Cunningham et al. | |
| 6,867,154 | B1 * | 3/2005 | Lunsford et al. | 442/136 |
| 6,974,785 | B1 | 12/2005 | Barbeau et al. | |
| 7,013,496 | B2 * | 3/2006 | Dunn | 2/458 |
| 7,065,950 | B2 | 6/2006 | Zhu et al. | |
| 7,073,538 | B2 | 7/2006 | Bhatnagar et al. | |
| 7,156,883 | B2 | 1/2007 | Lovasic et al. | |
| 7,284,398 | B2 | 10/2007 | Hubner | |
| 7,393,800 | B2 * | 7/2008 | Corner | 442/302 |
| 7,402,538 | B2 | 7/2008 | Bader et al. | |
| 7,589,036 | B2 * | 9/2009 | Corner et al. | 442/301 |
| 7,634,819 | B2 | 12/2009 | Grey | |
| 7,676,855 | B2 * | 3/2010 | Dunn | 2/458 |
| 7,854,017 | B2 * | 12/2010 | Laton | 2/81 |
| 7,862,865 | B2 * | 1/2011 | Truesdale et al. | 427/430.1 |
| RE42,209 | E * | 3/2011 | Lunsford et al. | 442/136 |
| 8,017,532 | B2 | 9/2011 | Okada | |
| 8,327,469 | B2 | 12/2012 | Curtis | |
| 8,347,420 | B2 | 1/2013 | Kruszewski et al. | |
| 8,898,821 | B2 * | 12/2014 | Stanhope et al. | 2/458 |
| 2001/0009832 | A1 | 7/2001 | Shaffer et al. | |
| 2002/0016985 | A1 * | 2/2002 | Kelleher et al. | 2/458 |
| 2002/0069453 | A1 * | 6/2002 | Kelleher et al. | 2/458 |
| 2003/0082972 | A1 * | 5/2003 | Monfalcone et al. | 442/138 |
| 2003/0167580 | A1 * | 9/2003 | Lunsford et al. | 8/531 |
| 2003/0226612 | A1 | 12/2003 | Zhu et al. | |
| 2003/0228812 | A1 * | 12/2003 | Stanhope et al. | 442/49 |
| 2004/0029473 | A1 | 2/2004 | McKee et al. | |
| 2004/0045103 | A1 * | 3/2004 | Lunsford et al. | 8/531 |
| 2004/0065072 | A1 | 4/2004 | Zhu et al. | |
| 2004/0152378 | A1 * | 8/2004 | Stanhope et al. | 442/5 |
| 2005/0032449 | A1 | 2/2005 | Lovasic et al. | |
| 2005/0050619 | A1 * | 3/2005 | Dunn | 2/458 |
| 2005/0060820 | A1 * | 3/2005 | Lunsford et al. | 8/518 |
| 2005/0064020 | A1 | 3/2005 | Schuette et al. | |
| 2005/0245163 | A1 | 11/2005 | Aneja et al. | |
| 2005/0287364 | A1 | 12/2005 | Zhu et al. | |
| 2006/0040575 | A1 * | 2/2006 | Kelleher et al. | 442/73 |
| 2006/0084337 | A1 * | 4/2006 | Corner et al. | 442/203 |
| 2006/0143809 | A1 * | 7/2006 | Dunn | 2/458 |
| 2006/0264136 | A1 * | 11/2006 | Chiantese | 442/304 |
| 2007/0184737 | A1 * | 8/2007 | Corner et al. | 442/203 |
| 2007/0249250 | A1 | 10/2007 | Servajean | |
| 2008/0057807 | A1 * | 3/2008 | Tutterow et al. | 442/1 |
| 2008/0086798 | A1 * | 4/2008 | Allen et al. | 2/458 |
| 2008/0148468 | A1 * | 6/2008 | Laton et al. | 2/455 |
| 2008/0152888 | A1 * | 6/2008 | Tutterow et al. | 428/221 |
| 2008/0227352 | A1 * | 9/2008 | Byles et al. | 442/312 |
| 2008/0295232 | A1 * | 12/2008 | Truesdale, III et al. | 2/458 |
| 2009/0030111 | A1 | 1/2009 | Barnes et al. | |
| 2009/0139016 | A1 | 6/2009 | Zhu et al. | |
| 2009/0178186 | A1 * | 7/2009 | Truesdale | 2/455 |
| 2009/0226653 | A1 | 9/2009 | Harris et al. | |
| 2009/0255038 | A1 | 10/2009 | Curtis | |
| 2010/0024103 | A1 * | 2/2010 | Kelleher et al. | 2/458 |
| 2010/0075557 | A1 | 3/2010 | Shteiyer | |
| 2010/0112312 | A1 * | 5/2010 | Tutterow et al. | 428/196 |
| 2010/0143683 | A1 | 6/2010 | Chiou | |
| 2011/0010827 | A1 * | 1/2011 | Stanhope et al. | 2/458 |
| 2011/0023206 | A1 | 2/2011 | Dunn | |
| 2011/0138523 | A1 | 6/2011 | Layson, Jr. et al. | |
| 2012/0031783 | A1 | 2/2012 | Fay, III et al. | |
| 2012/0090080 | A1 * | 4/2012 | Stanhope et al. | 2/458 |
| 2012/0183747 | A1 | 7/2012 | Bader | |
| 2012/0210481 | A1 | 8/2012 | Rock | |
| 2013/0216810 | A1 | 8/2013 | Hines et al. | |

FOREIGN PATENT DOCUMENTS

| | | | |
|---|---|---|---|
| DE | 20 2010 011 193 | U1 | 11/2010 |
| DE | 20 2010 011193 | U1 | 11/2010 |
| KR | 1020060122840 | | 11/2006 |
| KR | 1020070012391 | | 1/2007 |
| WO | 02/20887 | A2 | 3/2002 |
| WO | 02052077 | | 7/2002 |
| WO | 2004088023 | | 10/2004 |
| WO | 2006043958 | | 4/2006 |
| WO | 2007061423 | | 5/2007 |
| WO | 2010091476 | | 8/2010 |

* cited by examiner

FLAME RESISTANT FABRIC WITH ANISOTROPIC PROPERTIES

RELATED APPLICATIONS

This application is a continuation of U.S. patent application Ser. No. 13/303,495, filed Nov. 23, 2011, which issued as U.S. Pat. No. 8,898,821 on Dec. 2, 2014, which is a continuation-in-part of U.S. patent application Ser. No. 12/783,368, filed May 19, 2010, abandoned, which claims the benefit of U.S. Provisional Patent Application Ser. No. 61/179,461, filed May 19, 2009, each of which is incorporated by this reference herein in their entireties.

FIELD OF THE INVENTION

This invention relates to a flame resistant fabric, and more specifically to a flame resistant fabric having different properties on each side of the fabric.

BACKGROUND OF THE INVENTION

Flame resistant fabrics, and in particular garments, are desirable in many military and industrial applications. Military personnel in the field, for example, can be exposed to flash fire or electrical arc situations and it is therefore desirable that their combat uniforms provide protection from such conditions. While many fabrics provide suitable flame resistance properties and can be incorporated into combat uniforms and other industrial protective gear, flame resistance is not the only requirement for such fabrics. Other factors, such as comfort, durability, thermal performance, printability, dyeability and cost are also considered when evaluating the suitability of a fabric for military or industrial applications.

Not all protective fabrics are the same. Fabrics made entirely from inherently flame resistant fibers such as para-aramids and meta-aramids, for example, provide excellent flame resistance but garments made therefrom do not naturally absorb water and thus have poor moisture management properties. These garments can thus be uncomfortable on the skin of the wearer. This drawback can be tempered by the inclusion of softer and more absorbent fiber, such as cellulosic fibers. Such fibers, however, are less durable than inherently flame resistant fibers.

Fabrics made from blends of different fibers can have some of the beneficial properties of the individual fibers, but with those benefits come the drawbacks of each fiber. Thus, it has traditionally been necessary to select fiber blends for a fabric to maximize the desirable properties in the fabric while minimizing the undesirable effects of these fibers. This balancing act has not always been successfully performed.

Thus, a need exists for a fabric in which desirable properties can more easily be imparted to the fabric and in which negative effects due to use of particular fibers can be minimized.

SUMMARY OF EMBODIMENTS OF THE INVENTION

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

The present invention is directed to flame resistant fabrics formed by warp and fill yarns having different fiber contents. The fabrics are constructed such that the body side of the fabric (the side of the fabric on the side of the body of the wearer (assuming the fabric will be incorporated into a garment)) and the face side of the fabric (the side of the fabric facing away from the body of the wearer) have different properties. For example, it may be desirable for the body side of the fabric to be relatively softer and more absorbent, and thus more comfortable, for contact with the skin of the wearer, and for the face side of the fabric to have improved durability at the expense of comfort (since comfort is not as much of a consideration on the face side of the fabric).

In one embodiment, a flame resistant fabric includes warp yarns and fill yarns and has a body side and a face side. Either of the warp yarns or the fill yarns comprises a first fiber content and the other of the warp yarns or the fill yarns comprises a second fiber content different from the first fiber content. Fibers of the first fiber content are predominantly exposed on the body side of the fabric; and fibers of the second fiber content are predominantly exposed on the face side of the fabric.

In some embodiments, the warp yarns and fill yarns can have different amounts of the same fibers or, in yet other embodiments, can have different fibers or different blends of fibers.

In still another embodiment, the body fibers and the face fibers are woven in the fabric. The weave can be one or more of a twill, satin or sateen weave.

In other embodiments, garments formed from the flame resistant fabric described above are provided. The garments are suitable for use in military and industrial applications, and are particularly suitable for use in a military battle dress uniform.

In yet other embodiments, methods of making the flame resistant fabric and methods of making garments from the flame resistant fabric are provided.

DETAILED DESCRIPTION OF EMBODIMENTS OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The fabrics described herein have anisotropic properties, i.e., they have different properties on the body side of the fabric and the face side of the fabric. This is accomplished by providing warp yarns having a first fiber content and fill yarns having a second fiber content different from the first fiber content. In other words, either the warp yarns and fill yarns do not have identical fibers or blends of fibers, or the warp yarns and fill yarns contain different amounts of the same fibers. By way of example, the warp yarns could contain 30% FR cellulosic fibers and 70% para-aramid fibers and the fill yarns could contain 65% FR cellulosic fibers and 35% para-aramid fibers (i.e., identical fibers but in different amounts). Alternatively, the warp yarns could contain 65% modacrylic fibers and 35% para-aramid fibers and the fill yarns could contain 65% FR cellulosic fibers and 35% para-aramid fibers (i.e., different blends of fibers). Exemplary fiber blends are discussed in more detail below.

Suitable fiber blends according to the present invention include any of the fiber blends contemplated in U.S. patent application Ser. No. 11/847,993 (the "'993 application"), entitled "Flame Resistant Fabrics and Garments Made From Same" and published as US-2008-0057807-A1, as well as U.S. Pat. No. 6,867,154 (the "'154 patent"), entitled "Patterned, Flame Resistant Fabrics and Method For Making Same" and issued Mar. 15, 2005, the entire contents of each of which are herein incorporated by reference.

In some embodiments, the warp yarns and the fill yarns are formed from fibers or blends of fibers that include one or more of modacrylic fibers, cellulosic fibers (natural and synthetic, FR and non-FR), inherently FR fibers (e.g., aramids, PBI, PBO, etc.) and other non-FR fibers.

Suitable modacrylic fibers include, but are not limited to, PROTEX™ fibers (including but not limited to PROTEX W™, PROTEX C™ and PROTEX M™ fibers) available from Kaneka Corporation of Osaka, Japan, and SEF™ fibers, available from Solutia.

The cellulosic fibers may be natural or synthetic. Suitable natural cellulosic fibers include, but are not limited to, cotton, flax, hemp or blends thereof. The synthetic cellulosic fibers may be, but are not limited to, rayon, FR rayon, lyocell, cellulose acetate, or blends thereof. An example of a suitable rayon fiber is MODAL™ by Lenzing, available from Lenzing Fibers Corporation. Examples of lyocell fibers include TENCEL™, available from Lenzing Fibers Corporation. Examples of FR rayon fibers include Lenzing FR™, also available from Lenzing Fibers Corporation.

Cellulosic fibers (natural or synthetic) are not naturally resistant to flame. To increase the flame resistance of these fibers, one or more flame retardants may be incorporated into the fibers during the manufacturing process. Effective flame retardants include phosphorus compounds and antimony compounds. However, the cellulosic fibers need not always be rendered flame resistant. For example, if the cellulosic fibers are being blended with FR modacrylic fibers that control and counteract the flammability of the cellulosic fibers to prevent such fibers from burning, they need not be flame resistant. Use of non-FR cellulosic fibers instead of FR cellulosics significantly reduces the cost of fabrics made from such fibers. Again, however, both FR and non-FR cellulosic fibers are contemplated herein.

Other non FR fibers (natural or synthetic) can also be used as long as they are added in low enough levels (typically less than about 15% by weight) such that they will not detrimentally affect the thermal characteristics of fabric. Examples of such non-flame resistant fibers include, but are not limited to: (1) anti-static fibers to dissipate or minimize static, (2) antimicrobial fibers, (3) stretch fibers (e.g., spandex), (4) other fibers such as nylon and/or polyester fibers, and/or (5) other fibers that are added to the blends to improve the abrasion resistance of the fabrics.

Suitable inherently FR fibers include, but are not limited to, para-aramid fibers, meta-aramid fibers, polybenzimidazole (PBI) fibers, polybenzoxazole (PBO) fibers, melamine fibers, carbon fibers, pre-oxidized acrylic fibers, polyacrylonitrile (PAN) fibers, TANLON™ (available from Shanghai Tanlon Fiber Company), polyamide-imide fibers such as KERMEL™, and blends thereof. Examples of para-aramid fibers include KEVLAR™ (available from DuPont), TECHNORA™ (available from Teijin Twaron BV of Arnheim, Netherlands), and TWARON™ (also available from Teijin Twaron BV). Examples of meta-aramid fibers include NOMEX™ (available from DuPont) and CONEX™ (available from Teijin). An example of melamine fibers is BASOFIL™ (available from Basofil Fibers). An example of PAN fibers is Panox® (available from the SGL Group). As explained above, such inherently FR fibers impart the requisite thermal stability to the blend to enable fabrics made from such blends to be used in protective garments.

The yarns can be formed in conventional ways well known in the industry. The yarns may be spun yarns and can comprise a single yarn or two or more individual yarns that are twisted, or otherwise combined, together. In one embodiment, the yarns are air jet spun yarns. Typically, the yarns comprise one or more yarns that each have a yarn count in the range of approximately 5 to 60 cc. In other embodiments, the yarns comprise two yarns that are twisted together, each having a yarn count in the range of approximately 10 to 60 cc.

The FR fabrics formed with the blends disclosed herein preferably, but not necessarily, have a weight between approximately 3-12 ounces per square yard ("osy") and more preferably between approximately 5-9 osy.

As discussed above, it may be desirable for the body side of the fabric to be relatively softer and more absorbent, and thus more comfortable, for contact with the skin of the wearer, and for the face side of the fabric to have improved durability at the expense of comfort (since comfort is not as much of a consideration on the face side of the fabric). Such fabric constructions can be achieved using weaving and knitting processes.

In a typical weaving process according to the present invention, the fibers on the face side of the fabric will predominantly comprise the warp yarns and the fibers on the body side of the fabric will predominantly comprise the fill yarns. The fabric may be constructed with the warp and fill yarns in a variety of ways, including but not limited to, one or more of twill weave (2×1, 3×1, etc.), satin weave (4×1, 5×1, etc.), and sateen weave constructions, or any other weave where yarn is predominantly more on one side of the fabric than the other side of the fabric. A person skilled in the art would be familiar with and could utilize suitable fabric constructions.

Notwithstanding the above, it will be understood that the fabric can be constructed such that the fibers on the face side of the fabric predominantly comprise the fill yarns and the fibers on the body side of the fabric predominantly comprise the warp yarns. In such a construction, a weave will be selected such that a comfortable fiber blend (e.g., a blend including one or more cellulosic fibers) is predominantly exposed on the body side of the fabric. A person skilled in the art would understand how to select an appropriate weave pattern so as to locate predominantly more of either the warp or fill yarns on one side of the fabric.

It should be noted that plain or ripstop weaves will typically not be used, because in such weaves there are an equal number of warp yarns and fill yarns on each side (i.e., the body side and face side) of the fabric, and both sides of the fabric would thus have the same properties.

It will also be recognized that any woven fabric will have both warp and fill yarns visible on each side of the fabric.

Fabrics woven in accordance with the present invention, however, are woven such that more of either the warp yarns or the fill yarns are located on the face side of the fabric, and thus more of either the fill yarns or the warp yarns are located on the body side of the fabric. Thus, in an exemplary fabric construction in which more of the warp yarns are located on the face side of the fabric and more of the fill yarns are located, or exposed, on the body side of the fabric, the warp yarns are "predominantly" located, or exposed, on the face side of the fabric (even though some warp yarns would be visible from the body side of the fabric) and the fill yarns are "predominantly" located, or exposed, on the body side of the fabric (even though some fill yarns would be visible from the face side of the fabric).

In other embodiments of the invention, a knit fabric that has different properties on each side of the fabric can be constructed. Such a fabric could be constructed using a double-knit circular knitting machine. These machines have two needles, a dial needle and a cylinder needle, that work together to form the double-knit fabric. When utilized to make fabrics according to embodiments of the invention, different yarns can be used in each of the dial needle and cylinder needle such that the two yarns become inter-stitched with one yarn predominantly exposed on one side of the knit fabric and the other yarn predominantly exposed on the other side of the fabric. A yarn comprising cellulosic fibers could be knit into a fabric by at least one of the dial needle or cylinder needle so that a cellulosic-containing yarn is predominantly exposed on the body side of the fabric. Garments could be constructed from knit fabrics according to the embodiments described above.

As discussed above, in some embodiments the yarns of the present invention are formed from fibers or blends of fibers that include one or more of modacrylic fibers, cellulosic fibers (natural and synthetic, FR and non-FR), inherently FR fibers (e.g., aramids, PBI, PBO, etc.) and other non-FR fibers. In a more specific embodiment, a blend of fibers intended for a yarn that is predominantly exposed on the body side of a fabric includes approximately 20-80% by weight cellulosic fibers, approximately 0-55% by weight modacrylic fibers, approximately 0-80% by weight inherently FR fibers, and approximately 0-15% by weight other non-FR fibers (such as nylon).

In yet another embodiment, fibers or a blend of fibers intended for a yarn that is predominantly exposed on the face side of a fabric includes 0-100% of one or more of modacrylic fibers, cellulosic fibers (natural and synthetic, FR and non-FR), inherently FR fibers and other non-FR fibers. Thus, any suitable fiber or blend of fibers can be selected as long as the overall fabric remains flame resistant.

Dyeing and printing of such fabrics may be carried out in accordance with standard methods, all of which are known to those of skill in the art. Such methods include, but are not limited to, those dyeing and/or printing methods disclosed in the '154 patent and the '993 application. Although it will be recognized that certain fibers and fiber blends are more dyeable than others, it is desirable that both sides of the fabric be at least somewhat dyeable and printable. If only one side (i.e., the face side) of the fabric were dyeable and/or printable, the fabric is susceptible to "grin-through" or contrasting shades from the non-dyed/non-printed fibers that, though predominantly on the body side of the fabric, would also be at least partially visible on the face side of the fabric. Moreover, it is more difficult to produce a fabric that will pass military infrared reflectance requirements if the fabric has "grin through." Another benefit of having a garment, such as a shirt, that includes a fabric that is dyed and/or printed on both sides is the wearer can roll their shirt sleeves up and still have color or a print pattern on the body side of the fabric.

Suitable dyes for the fabrics described herein include direct, reactive, and vat dyes. Of these, vat dyes may be particularly useful for fabrics of the present invention because they satisfy military requirements GL-PD-07-12, Revision 4 (as referenced below).

In yet other embodiments, the fabric described herein may include at least 10% para-aramid fibers (including fibers in both the warp and fill yarns), and may include up to 30% para-aramid fibers.

In some embodiments, the yarns predominantly on the face side of the fabric (e.g., the warp yarns) include no more than about 15% para-aramid fibers and the yarns predominantly on the body side of the fabric (e.g., the fill yarns) include no more than about 60% para-aramid fibers and at least about 20% comfort fibers such as the cellulosic fibers described above. All, some or none of the comfort fibers may be treated with a flame retardant, as long as the overall fabric remains flame resistant and meets flame resistant standards described herein.

Fabrics described herein and dyed as described above may also have improved colorfastness as compared to previously known fabrics. Fabrics formed from fiber blends of the construction described in the previous paragraph may have relatively high para-aramid fiber content on the body side of the fabric (up to about 60%). Para-aramid fibers are desirable because they are inherently flame resistant and because they are high tenacity fibers that impart strength to the resulting yarns and fabrics. Para-aramid fibers, however, have a tendency to fibrillate after washing, and fibrillation of fiber blends having a high para-aramid content may impart a frosted appearance to the yarn. While such a frosted appearance may not be desirable if these blends were predominantly on the face side of the fabric, the frosted appearance is not a substantial issue when it occurs predominantly on the body side of the fabric.

In contrast to para-aramid fibers, meta-aramid fibers do not fibrillate after washing. As a result, it may be desirable to include meta-aramid fibers on the face side of the fabric for improved after-wash appearance.

Fabrics formed in accordance with the embodiments described herein preferably meet certain industrial and/or military standards for flame resistance. In particular, the fabrics preferably have an after-flame of less than 2 seconds and less than a 4-inch char length when tested in accordance with ASTM D 6413 ("Standard Test Method for Flame Resistance of Textiles"). In addition, such fabrics preferably comply with National Fire Protection Association ("NFPA") 2112 ("Standard on Flame-Resistant Garments for Protection of Industrial Personnel Against Flash Fire"). In other embodiments, fabrics according to the present invention satisfy the U.S. Army requirements for the flame resistant Advanced Combat Uniform as specified in GL-PD-07-12, Revision 4. These test methods and standards are incorporated by reference herein in their entirety.

The fabrics with anisotropic properties described herein, having different properties on the body side and face side of the fabric, can thus be customized so that a particular desirable property can be achieved on one side of the fabric without substantially affecting the properties on the other side of the fabric. For example, a cost effective fabric having desirable comfort, flame resistance, durability, thermal stability, and other properties can be optimized for one side of the fabric without substantially affecting other desirable properties on the other side of the fabric.

In addition, while the fibers described above for the warp yarns and fill yarns are primarily described as being a blend of fibers, it will be recognized that in some embodiments these yarns need not be blended at all. In other words, the warp yarns could be 100% of one fiber type and/or the fill yarns could be 100% of another fiber type. The warp and fill yarns should not, of course, each have 100% of the same fiber (e.g., 100% FR Rayon for both the warp and fill yarns), otherwise no matter how the fabric is woven both sides of the fabric would have the same properties.

The fabrics described herein can be incorporated into military or industrial garments, including but not limited to combat uniforms, shirts, jackets, trousers and coveralls.

In another embodiment, a method of making a fabric having anisotropic properties is provided. In the method, a woven fabric according to embodiments described above is formed such that the warp yarns have a fiber content that is different than the fiber content of the fill yarns. In other words, either the warp yarns and fill yarns do not have identical fibers or blends of fibers, or the warp yarns and fill yarns contain different amounts of the same fibers.

In yet another embodiment, a method of making a garment from a fabric having anisotropic properties is provided. In the method, a fabric formed according to embodiments described above is incorporated into a garment.

The present invention is further illustrated by way of the examples contained herein, which are provided for clarity of understanding. The exemplary embodiments should not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLES

Fabrics having the fiber blends listed in Table 1 were prepared:

TABLE 1

| Fabric No. | Warp blend (predominantly face side) | Fill blend (predominantly body side) | Weave |
|---|---|---|---|
| 1 | 50/45/5 FR rayon/T-450 Nomex ™/ para-aramid | 40/30/20/5 Modacrylic/Tencel ™/para-aramid/nylon | 3 × 1 Twill |
| 2 | 50/35/5/10 FR rayon/T-450 Nomex ™/ para-aramid/nylon | 65/25/10 FR rayon/para-aramid/ nylon | 3 × 1 Twill |
| 3 | 55/35/10 FR rayon/Nomex IIIA*/ nylon | 50/50 FR rayon/para-aramid | 3 × 1 Twill |
| 4 | 55/35/10 FR rayon/Nomex IIIA*/ nylon | 50/40/10 FR rayon/para-aramid/ nylon | 3 × 1 Twill |
| 5 | 55/35/10 FR rayon/Nomex IIIA*/ nylon | 50/50 FR rayon/para-aramid | 2 × 1 Twill |
| 6 | 55/35/10 FR rayon/Nomex IIIA*/ nylon | 50/40/10 FR rayon/para-aramid/ nylon | 2 × 1 Twill |

*Nomex IIIA contains 93/5/2 meta-aramid fibers/para-aramid fibers/antistatic fibers The warp and fill yarns of Fabric Nos. 1-6 each had a different fiber content, and the fill blend (i.e., predominantly exposed on the body side of the fabric) included cellulosic fibers (FR rayon).

The fabrics of Examples 3-6 were made using 64% warp yarns and 36% fill yarns. The fabrics of Examples 3 and 5 thus have approximately 19% para-aramid fibers (64% of 1.75% para-aramid fibers in the warp blend (5% of 35%) and 36% of 50% para-aramid fibers in the fill blend), and the fabrics of Examples 4 and 6 thus have approximately 16% para-aramid fibers (64% of 1.75% para-aramid fibers in the warp blend and 36% of 40% para-aramid fibers in the fill blend). Both sides of these fabrics are dyeable and/or printable to dark shades, and any frosting appearance due to washing in the para-aramid fibers is most pronounced in the fill blend, which is predominantly located on the body side of the fabric. The fabrics thus have good after-wash appearance.

Different arrangements of the components described above, as well as components and steps not described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above, and various embodiments and modifications can be made without departing from the scope of the claims below.

We claim:

1. A flame resistant fabric formed of warp yarns and fill yarns and comprising a body side and a face side, wherein:
- (a) either of the warp yarns or the fill yarns comprise a first fiber content;
- (b) the other of the warp yarns or the fill yarns comprise a second fiber content different from the first fiber content;
- (c) fibers of the first fiber content are predominantly exposed on a body side of the fabric;
- (d) fibers of the second fiber content are predominantly exposed on a face side of the fabric;
- (e) the fabric comprises at least 10% para-aramid fibers and more of the para-aramid fibers are located in the first fiber content than in the second fiber content; and
- (f) the fabric is a single layer fabric.

2. The fabric of claim 1, wherein the fabric is dyeable and printable.

3. The fabric of claim 1, wherein the warp yarns and fill yarns comprise different amounts of the same fibers.

4. The fabric of claim 1, wherein the warp yarns and fill yarns comprise different fibers or different blends of fibers.

5. The fabric of claim 1, wherein the warp yarns and fill yarns are woven using one or more of a twill weave, a satin weave and a sateen weave.

6. The fabric of claim 1, wherein the first fiber content comprises approximately 20-80% cellulosic fibers.

7. The fabric of claim 6, wherein the first fiber content further comprises one or more of modacrylic fibers, inherently flame resistant fibers, and nylon fibers.

8. A garment formed from the fabric of claim 1.

9. The garment of claim 8, wherein the garment is a military combat uniform.

10. The fabric of claim 1, wherein the fabric has an after-flame of less than 2 seconds and less than a 4-inch char length when tested in accordance with ASTM D 6413.

11. The fabric of claim 1, wherein the fabric complies with NFPA 2112.

12. The fabric of claim 1, where in the fabric complies with GL-PD-07-12, Revision 4.

13. A flame resistant fabric formed of warp yarns and fill yarns and comprising a body side and a face side, wherein:
- (a) either of the warp yarns or the fill yarns comprise a first fiber content;

(b) the other of the warp yarns or the fill yarns comprise a second fiber content different from the first fiber content;
(c) fibers of the first fiber content are predominantly exposed on a body side of the fabric;
(d) fibers of the second fiber content are predominantly exposed on a face side of the fabric;
(e) the fabric comprises at least 10% para-aramid fibers and more of the para-aramid fibers are located in the first fiber content than in the second fiber content; and
(f) the fibers of the first fiber content are 100% para-aramid fibers.

14. The fabric of claim 13, wherein the fabric is a single layer fabric.

15. The fabric of claim 13, wherein the fabric is dyeable and printable.

16. The fabric of claim 13, wherein the warp yarns and fill yarns comprise different fibers or different blends of fibers.

17. The fabric of claim 13, wherein the warp yarns and fill yarns are woven using one or more of a twill weave, a satin weave and a sateen weave.

18. A garment formed from the fabric of claim 13.

19. The garment of claim 18, wherein the garment is a military combat uniform.

20. The fabric of claim 13, wherein the fabric has an after-flame of less than 2 seconds and less than a 4-inch char length when tested in accordance with ASTM D 6413.

21. The fabric of claim 13, wherein the fabric complies with NFPA 2112.

22. The fabric of claim 13, where in the fabric complies with GL-PD-07-12, Revision 4.

23. The fabric of claim 1, wherein the fibers of the first fiber content are 100% para-aramid fibers.

24. The fabric of claim 1, wherein the warp yarns or fill yarns comprising the first fiber content further comprise at least one additional yarn combined or twisted therewith.

25. The fabric of claim 24, wherein the fibers of the first fiber content are 100% para-aramid fibers.

26. The fabric of claim 13, wherein the warp yarns or fill yarns comprising the first fiber content further comprise at least one additional yarn combined or twisted therewith.

27. A flame resistant fabric formed of warp yarns interwoven with fill yarns and comprising a body side and a face side, wherein:
(a) at least some of either of the warp yarns or the fill yarns comprise a first fiber content;
(b) at least some of the other of the warp yarns or the fill yarns comprise a second fiber content different from the first fiber content;
(c) fibers of the first fiber content are predominantly exposed on a body side of the fabric;
(d) fibers of the second fiber content are predominantly exposed on a face side of the fabric;
(e) the fabric comprises at least 10% para-aramid fibers, more of the para-aramid fibers are located in the first fiber content than in the second fiber content, and more of the para-aramid fibers are located on the body side than on the face side of the fabric;
(f) the fabric is a single layer fabric; and
(g) the first and second fiber contents together comprise at least three different types of flame resistant fibers.

28. A garment comprising the fabric of claim 27.

29. The fabric of claim 27, wherein the first fiber content and the second fiber content comprise different fiber types or different blends of the same fiber types.

30. The fabric of claim 27, wherein the fabric has an after-flame of less than 2 seconds and less than a 4-inch char length when tested in accordance with ASTM D 6413.

31. The fabric of claim 27, wherein all of either of the warp yarns or the fill yarns comprise the first fiber content.

32. The fabric of claim 31, wherein all of the other of the warp yarns or the fill yarns comprise the second fiber content.

33. The fabric of claim 27, wherein all of the other of the warp yarns or the fill yarns comprise the second fiber content.

34. The fabric of claim 33, wherein all of either of the warp yarns or the fill yarns comprise the first fiber content.

35. The fabric of claim 27, wherein at least one of the at least three different types of flame resistant fibers is selected from the group consisting of para-aramid fibers, meta-aramid fibers, flame resistant cellulosic fibers, and modacrylic fibers.

36. A garment comprising the fabric of claim 35.

37. The fabric of claim 27, wherein at least two of the at least three different types of flame resistant fibers are selected from the group consisting of para-aramid fibers, meta-aramid fibers, flame resistant cellulosic fibers, and modacrylic fibers.

38. A garment comprising the fabric of claim 37.

39. The fabric of claim 27, wherein the at least three different types of flame resistant fibers are selected from the group consisting of para-aramid fibers, meta-aramid fibers, flame resistant cellulosic fibers, and modacrylic fibers.

40. A garment comprising the fabric of claim 39.

41. The fabric of claim 27, wherein the second fiber content comprises at least one of modacrylic fibers, cellulosic fibers, and inherently flame resistant fibers.

42. A garment comprising the fabric of claim 41.

43. The fabric of claim 41, wherein the second fiber content comprises a blend of cellulosic fibers and inherently flame resistant fibers and wherein the inherently flame resistant fibers comprise meta-aramid fibers.

44. A garment comprising the fabric of claim 43.

45. The fabric of claim 27, wherein the fibers of the first fiber content are 100% para-aramid fibers.

46. A garment comprising the fabric of claim 45.

47. The fabric of claim 27, wherein the at least some of the warp yarns or fill yarns comprising the first fiber content further comprise at least one additional yarn combined or twisted therewith.

48. The fabric of claim 47, wherein the fibers of the first fiber content are 100% para-aramid fibers.

49. A flame resistant fabric formed of warp yarns interwoven with fill yarns and comprising a body side and a face side, wherein:
(a) at least some of either of the warp yarns or the fill yarns comprise a first fiber content;
(b) at least some of the other of the warp yarns or the fill yarns comprise a second fiber content different from the first fiber content;
(c) fibers of the first fiber content are predominantly exposed on a body side of the fabric;
(d) fibers of the second fiber content are predominantly exposed on a face side of the fabric;
(e) the fabric comprises at least 10% para-aramid fibers, more of the para-aramid fibers are located in the first fiber content than in the second fiber content, and more of the para-aramid fibers are located on the body side than on the face side of the fabric;
(f) the fibers of the first fiber content are 100% para-aramid fibers; and
(g) the fabric is a single layer fabric.

50. A garment comprising the fabric of claim 49.

51. The fabric of claim 49, wherein the first fiber content and the second fiber content comprise different fiber types or different blends of the same fiber types.

52. The fabric of claim 49, wherein all of either of the warp yarns or the fill yarns comprise the first fiber content.

53. The fabric of claim 52, wherein all of the other of the warp yarns or the fill yarns comprise the second fiber content.

54. The fabric of claim 49, wherein all of the other of the warp yarns or the fill yarns comprise the second fiber content.

55. The fabric of claim 54, wherein all of either of the warp yarns or the fill yarns comprise the first fiber content.

56. The fabric of claim 49, wherein the second fiber content comprises at least one of modacrylic fibers, cellulosic fibers, and inherently flame resistant fibers.

57. A garment comprising the fabric of claim 56.

58. The fabric of claim 56, wherein the second fiber content comprises a blend of cellulosic fibers and inherently flame resistant fibers and wherein the inherently flame resistant fibers comprise meta-aramid fibers.

59. A garment comprising the fabric of claim 58.

60. The fabric of claim 49, wherein the fabric comprises at least three different types of flame resistant fibers and wherein at least one of the at least three different types of flame resistant fibers is selected from the group consisting of para-aramid fibers, meta-aramid fibers, flame resistant cellulosic fibers, and modacrylic fibers.

61. A garment comprising the fabric of claim 60.

62. The fabric of claim 60, wherein at least two of the at least three different types of flame resistant fibers are selected from the group consisting of para-aramid fibers, meta-aramid fibers, flame resistant cellulosic fibers, and modacrylic fibers.

63. A garment comprising the fabric of claim 62.

64. The fabric of claim 60, wherein the at least three different types of flame resistant fibers are selected from the group consisting of para-aramid fibers, meta-aramid fibers, flame resistant cellulosic fibers, and modacrylic fibers.

65. A garment comprising the fabric of claim 64.

66. The fabric of claim 49, wherein the fabric has an after-flame of less than 2 seconds and less than a 4-inch char length when tested in accordance with ASTM D 6413.

67. The fabric of claim 49, wherein the fabric complies with NFPA 2112.

68. The fabric of claim 49, wherein the at least some of the warp yarns or fill yarns comprising the first fiber content further comprise at least one additional yarn combined or twisted therewith.

69. A flame resistant fabric formed of warp yarns interwoven with fill yarns and comprising a body side and a face side, wherein:

(a) at least some of either of the warp yarns or the fill yarns comprise a first fiber content;

(b) at least some of the other of the warp yarns or the fill yarns comprise a second fiber content different from the first fiber content;

(c) fibers of the first fiber content are predominantly exposed on a body side of the fabric;

(d) fibers of the second fiber content are predominantly exposed on a face side of the fabric;

(e) the fabric comprises at least 10% para-aramid fibers, more of the para-aramid fibers are located in the first fiber content than in the second fiber content, and more of the para-aramid fibers are located on the body side than on the face side of the fabric;

(f) the first and second fiber contents together comprise at least three different types of flame resistant fibers;

(g) the fibers of the first fiber content are 100% para-aramid fibers;

(h) the second fiber content comprises at least one of modacrylic fibers, cellulosic fibers, and inherently flame resistant fibers; and (i) the fabric is a single layer fabric.

70. The fabric of claim 69, wherein all of either of the warp yarns or the fill yarns comprise the first fiber content.

71. The fabric of claim 70, wherein all of the other of the warp yarns or the fill yarns comprise the second fiber content.

72. The fabric of claim 69, wherein all of the other of the warp yarns or the fill yarns comprise the second fiber content.

73. The fabric of claim 72, wherein all of either of the warp yarns or the fill yarns comprise the first fiber content.

74. The of claim 69, wherein at least one of the at least three different types of flame resistant fibers is selected from the group consisting of para-aramid fibers, meta-aramid fibers, flame resistant cellulosic fibers, and modacrylic fibers.

75. A garment formed from the fabric of claim 74.

76. The fabric of claim 69, wherein at least two of the at least three different types of flame resistant fibers are selected from the group consisting of para-aramid fibers, meta-aramid fibers, flame resistant cellulosic fibers, and modacrylic fibers.

77. A garment formed from the fabric of claim 76.

78. The fabric of claim 69, wherein the at least three different types of flame resistant fibers are selected from the group consisting of para-aramid fibers, meta-aramid fibers, flame resistant cellulosic fibers, and modacrylic fibers.

79. A garment formed from the fabric of claim 78.

80. The fabric of claim 69, wherein the second fiber content comprises a blend of cellulosic fibers and inherently flame resistant fibers and wherein the inherently flame resistant fibers comprise meta-aramid fibers.

81. A garment formed from the fabric of claim 80.

* * * * *